US008368503B2

(12) United States Patent
Castillo et al.

(10) Patent No.: US 8,368,503 B2
(45) Date of Patent: Feb. 5, 2013

(54) TEMPERATURE SENSOR AND METHOD FOR ADJUSTING SUCH A TEMPERATURE SENSOR

(75) Inventors: Philipp Pérez Castillo, Bretten (DE); Willi Reichert, Kürnbach (DE); Bruno Schlenker, Sulzfeld (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 202 days.

(21) Appl. No.: 12/857,815

(22) Filed: Aug. 17, 2010

(65) Prior Publication Data

US 2011/0043322 A1 Feb. 24, 2011

(30) Foreign Application Priority Data

Aug. 19, 2009 (DE) ..... 10 2009 038 960

(51) Int. Cl.
*H01H 37/48* (2006.01)
*H01H 37/46* (2006.01)

(52) U.S. Cl. ..... 337/394; 337/123; 337/393; 337/398

(58) Field of Classification Search ..... 337/123, 337/139, 393–398
See application file for complete search history.

(56) References Cited

U.S. PATENT DOCUMENTS

| | | | | | |
|---|---|---|---|---|---|
| 2,496,229 | A | * | 1/1950 | Parkhurst | 337/389 |
| 2,990,716 | A | * | 7/1961 | Butts | 60/527 |
| 3,004,123 | A | * | 10/1961 | Cannon | 337/393 |
| 3,029,329 | A | * | 4/1962 | Bolesky | 337/386 |
| 3,194,927 | A | * | 7/1965 | Place | 337/387 |
| 3,235,691 | A | * | 2/1966 | Bixby et al. | 337/387 |
| 3,673,535 | A | | 6/1972 | Rosenberg et al. | |
| 3,899,765 | A | * | 8/1975 | Daigneault, Jr. | 337/386 |
| 3,921,198 | A | * | 11/1975 | Pohl | 337/337 |
| 4,544,831 | A | * | 10/1985 | Bayer | 219/445.1 |
| 4,555,688 | A | * | 11/1985 | Bayer | 337/394 |
| 4,577,176 | A | * | 3/1986 | Bayer | 337/394 |
| 4,604,603 | A | * | 8/1986 | Place | 337/394 |
| 4,633,238 | A | * | 12/1986 | Goessler et al. | 340/593 |
| 4,665,307 | A | * | 5/1987 | McWilliams | 219/448.19 |

(Continued)

FOREIGN PATENT DOCUMENTS

| | | |
|---|---|---|
| EP | 1 251 540 | 10/2002 |
| EP | 1 569 257 | 8/2005 |

(Continued)

OTHER PUBLICATIONS

German Patent and Trade Mark Office, Office Action for Application No. 102009038960.1-34, Mar. 11, 2010, 3 pages, Germany.

(Continued)

*Primary Examiner* — Anatoly Vortman
(74) *Attorney, Agent, or Firm* — Alston & Bird LLP

(57) ABSTRACT

A temperature sensor for a radiant heater has a first tubular expansion element which is connected to its housing and contains a second rod-like expansion element, the two expansion elements having different coefficients of thermal expansion. The temperature sensor has two switching springs for different switching points. In order to adjust a second switching spring, which is fastened to a second switching spring base, the second switching spring base can be moved in the longitudinal direction of the rod and is then permanently fixed by bending or welding.

13 Claims, 1 Drawing Sheet

U.S. PATENT DOCUMENTS

| | | | | |
|---|---|---|---|---|
| 4,695,816 | A * | 9/1987 | Essig et al. | 337/394 |
| 4,901,049 | A * | 2/1990 | Kicherer et al. | 337/394 |
| 5,310,993 | A * | 5/1994 | McWilliams et al. | 219/448.19 |
| 5,420,398 | A * | 5/1995 | Petri et al. | 219/505 |
| 5,627,507 | A * | 5/1997 | Morbitzer et al. | 337/394 |
| 6,007,327 | A * | 12/1999 | Morbitzer | 431/75 |
| 6,304,165 | B1 * | 10/2001 | Petri et al. | 337/394 |
| 6,646,538 | B2 * | 11/2003 | Morbitzer | 337/394 |
| 6,724,294 | B2 * | 4/2004 | Morbitzer | 337/394 |
| 7,119,654 | B2 * | 10/2006 | Losbichler | 337/394 |
| 7,345,572 | B2 * | 3/2008 | Losbichler et al. | 337/394 |
| 2002/0011917 | A1 | 1/2002 | Frank | |
| 2004/0178878 | A1 * | 9/2004 | Losbichler | 337/394 |

FOREIGN PATENT DOCUMENTS

| | | | |
|---|---|---|---|
| EP | 1 926 117 | | 5/2008 |
| GB | 449908 | | 7/1936 |
| GB | 2 175 141 | A | 11/1986 |
| WO | WO 2008/017397 | A1 | 2/2008 |

OTHER PUBLICATIONS

European Patent Office, Partial Search Report for Application No. 10172413.6, Nov. 25, 2011, 7 pages, Germany.

European Patent Office, Search Report and Written Opinion for Application No. 10172413.6, Jan. 23, 2012, 12 pages, Germany.

* cited by examiner

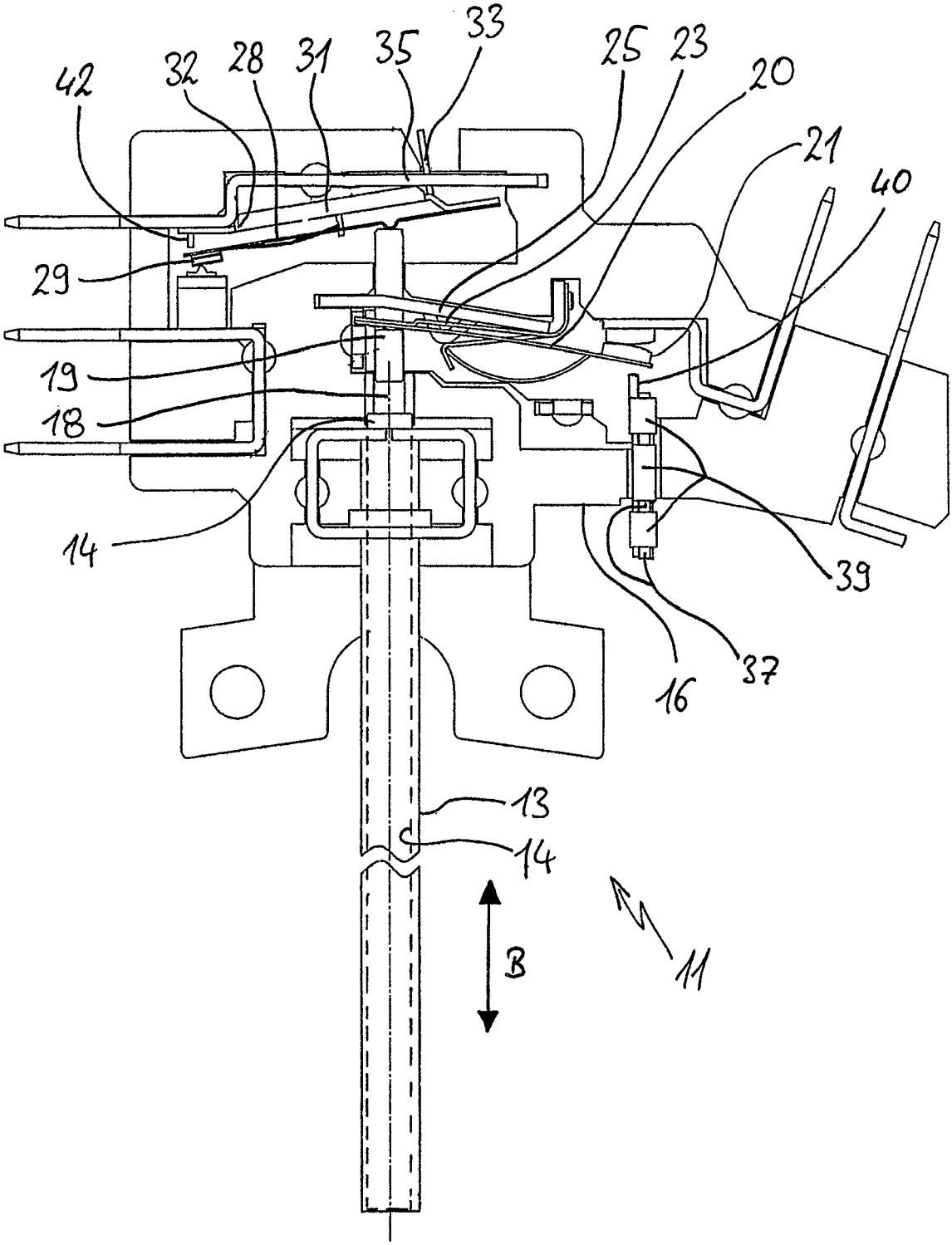
42
32
28
31
35
33
25
23
20
21
40
29
19
18
14
39
37
16
13
14
B
11

TEMPERATURE SENSOR AND METHOD FOR ADJUSTING SUCH A TEMPERATURE SENSOR

CROSS REFERENCE TO RELATED APPLICATIONS

This application claims priority to German Application Number 10 2009 038 960.1 filed on Aug. 19, 2009, the contents of which are incorporated by reference for all that it teaches.

FIELD OF THE INVENTION

The invention relates to a temperature sensor, in particular to a so-called "rod thermostat," and to a method for adjusting such a temperature sensor.

BACKGROUND OF THE INVENTION

U.S. Pat. No. 7,345,572 discloses a temperature sensor, which is also referred to as a rod thermostat. It contains two switching springs which are triggered by a second expansion element which is mounted in a tubular first expansion element. The first expansion element usually consists of a metal tube, whereas the second expansion element is a ceramic rod. As a result of different coefficients of thermal expansion, essentially only the tube expands during heating and the rod moves, relative to the latter, out of a housing of the temperature sensor, which contains the switching springs. The switching springs are triggered or switched at a respective triggering point provided for each switching spring, which is thus intended to be effected at two different temperatures which can be set. The setting of these triggering points or switching temperatures is very important and technically cannot be solved in a very simple manner.

The invention is based on solving the problem of providing a temperature sensor mentioned at the outset and a method for adjusting said temperature sensor, which can be used to solve problems of the prior art and, in particular, make it possible to carry out an above mentioned adjustment effectively in terms of the construction and procedure.

SUMMARY OF THE INVENTION

This problem is solved by a temperature sensor having the features as claimed herein, which includes a method for adjusting said temperature sensor as claimed herein. The claims relate to advantageous and preferred refinements of the invention which are explained in more detail below. Some of the features listed below are mentioned only for the temperature sensor or only for the method. However, irrespective of this, they are intended to be able to apply to both the temperature sensor and the method. The wording of the claims is incorporated in the description by express reference.

The temperature sensor has a housing which contains two switching springs, a first tubular expansion element being connected to the housing. This first expansion element contains a second expansion element which is in the form of a rod, the two expansion elements having different coefficients of thermal expansion and carrying out a relative movement with respect to one another in the event of heating or temperature changes. A first switching spring in the temperature sensor is pre-stressed with respect to a point and has a switching contact, the rod acting on one side of the switching spring, for which purpose an intermediate element can be advantageously provided, with the result that the rod does not directly touch the switching spring. A second switching spring which is fastened to a second switching spring base is provided in the effective direction of the rod or the elongated intermediate element as an extension of the rod.

According to one embodiment of the invention, the second switching spring base is designed in such a manner that it is movable or can be moved with at least one direction component in the longitudinal direction of the rod in order to adjust the switching point of the second switching spring. The position of the second switching spring base for use can then be advantageously permanently locked or fixed by locking means. The adjusted state of the switching spring is thus fixed.

Unlike in the prior art, this arrangement makes it possible to change the position of the second switching spring base in the housing of the temperature sensor itself, rather than changing the position of a switching spring, that is to say the second switching spring, with respect to its second switching spring base, to which it is fastened, as a relative movement. This considerably improves the adjustability and the switching accuracy. In particular, the second switching spring base can be permanently locked or fixed to the housing of the temperature sensor in a stable manner in this case, for example by firmly welding the metal switching spring base to a metal part in the temperature sensor housing. Subsequent changes or undesirable adjustments can thus be prevented.

In another embodiment of the invention, the rod rests against the first switching spring in the manner mentioned by means of the said intermediate element in order to trigger said spring at the triggering point or at its switching point. Such an intermediate element has the advantage that it may be designed in an elongated and rod-like manner and, through the switching spring, can thus also constitute the bearing point for the second switching spring.

It is possible to integrate adjustment for the triggering point of the first switching spring in this intermediate element or in a point at which the intermediate element bears against the rod or the first switching spring. This can be accomplished, for example, by means of an adjustable screw thread, for example, with a screw or setscrew which runs in the longitudinal direction of the rod and rests against the rod or the first switching spring. The triggering point can then be accurately set by rotating the screw. However, the setting operation is advantageously carried out by means of a metal pin which is inserted into the other end of the tube that is still open and against which the rod rests. The setting operation can then be carried out by moving the metal pin along the longitudinal direction of the tube, which setting can be made final by fastening the pin to the tube, for example by means of welding. However, this is known to a person skilled in the art.

The intermediate element advantageously consists of ceramic. The rod may possibly also be produced from metal.

The second switching spring base can be designed in such a manner that it is elongated and is connected to the second switching spring in an end region of the latter, which is remote from its end region with the switching contact. The second switching spring base is fixed in an unalterable manner to the temperature sensor housing in its other end region, in which case a certain movability or bendability in the form of a rotation through a small angle is intended to be possible here. An adjustable locking means for the switching spring base can be advantageously provided on the temperature sensor housing close to, or in the region of, the connection between the second switching spring base and the second switching spring, which locking means can be fixed either directly to the housing or to a part fixed in the latter in a different position. This fixing thus fixes the position of the second switching spring base and thus also of the second switching spring carried by the latter relative to the rod or an intermediate element which transmits the movement of the rod to the second switching spring.

In another embodiment of the invention, the locking means provided may be a section which protrudes from the second switching spring base and can run approximately at right angles to the longitudinal extent of the second switching spring base, that is to say, protrudes from the latter. A protruding locking arm, in particular, may be provided, which arm is fixed, and in particular may be welded to a metal part fastened in the housing for the purpose of fixing the final position of the second switching spring base in the housing. In this case, welding effects permanent fixing which can no longer be changed.

When adjusting a temperature sensor at a particular temperature at which the second switching spring is intended to be triggered or is intended to perform its switching function, the corresponding switching point is then set at the second switching spring while the locking means of the second switching spring base has not yet been fixed. For this purpose, the position of the second switching spring base is set accordingly such that the second switching spring switches here. The second switching spring base is then fixed in exactly this position, for example by permanently fastening the above mentioned locking section or locking arm to the housing of the temperature sensor. It can be welded to said metal part, in particular, as in this case. As an alternative to welding, permanent clamping connections or adhesive means are also possible. However, welding, in particular in the form of laser welding, is quick and is sufficiently stable and permanent.

The position of a first switching spring base in the temperature sensor housing may not be able to be changed, or for said spring base to be mounted only in a single position during assembly. In this case, the adjustment is advantageously carried out using the abovementioned intermediate element between the first switching spring base and the rod-like second expansion element. Alternatively, the triggering point of the first switching spring can also be adjusted using a variable arrangement of the rod in the tubular first expansion element, for example by connecting the two end regions which point away from the housing to one another and by this connection being able to be adjusted. For this purpose, an adjusting screw or a metal pin, against which the rod rests, can engage in the end of the tubular first expansion element in the longitudinal direction of the rod. The triggering point can be adjusted by adjustment in the longitudinal direction and the adjusting screw or the metal pin can finally be fixed, for example, clamped or welded.

According to another embodiment of the invention, in a second fundamental refinement of the invention, a mating contact is assigned to the switching contact and a counter-stop is provided in the other direction, that is to say away from the mating contact. The switching contact strikes said counter-stop when the switching spring is open. In this case, the counter-stop can be adjusted in the direction of the mating contact or away from the latter. In a preferred refinement of the invention, the counter-stop can be adjustable or adjusted approximately along the direction of movement of the switching contact when opening or closing the switching spring. The counter-stop can be used to influence the switching behaviour of the switching spring, in particular with regard to a hysteresis window, that is to say the two switching points for the two switching operations.

The counter-stop can be advantageously changed or adjusted by means of an at least temporarily given movability. It may be in the form of a slide on a holder in the form of a guide. The slide and holder can be fixed to one another, preferably by means of bending or crimping or welding, after the counter-stop has been set.

As an alternative, the counter-stop can be bent for the purpose of adjustment and its distance from the mating contact can be set by the bending. In this case, the counter-stop can be solid or stable such that it is not bent by the switching spring opening and striking in the process.

In a method for adjusting an above mentioned temperature sensor according to the second fundamental refinement, at a particular temperature at which the switching spring is intended to close again with the counter-stop, or in order to determine a desired hysteresis window between opening and closing of the switching spring, the counter-stop is moved in the direction of the mating contact until the switching spring switches again or closes at a desired temperature. The counter-stop can then be fixed or secured at this temperature. This can advantageously be carried out as described above.

These and further features emerge not only from the claims but also from the description and the drawing, the individual features in each case being able to be implemented on their own or a plurality of them being able to be implemented together in the form of subcombinations for one embodiment of the invention and in other fields and being able to represent advantageous embodiments which are patentable per se and for which protection is claimed here. The subdivision of the application into individual sections as well as intermediate headings do not restrict the generality of the statements made under said headings.

BRIEF DESCRIPTION OF THE DRAWING

An exemplary embodiment of a temperature sensor according to an embodiment of the invention with two switching springs is diagrammatically illustrated in FIG. 1.

DETAILED DESCRIPTION OF THE EXEMPLARY EMBODIMENT

FIG. 1 shows a sectional plan view of a temperature sensor 11 according to the invention with an elongated sensor part which consists, in a known manner, of a tube 13, usually a metal tube, and an elongated rod 14, usually a ceramic rod, contained in said tube. In the case of temperature fluctuations, the tube 13 and the rod 14 undergo different linear expansions in their longitudinal direction, thus resulting in a relative movement in the direction of movement B. Since the lower end of the rod 14 is either pressed into the tube 13 with a spring force acting from above or is even fixed, for example clamped, in said tube, a longitudinal movement results at the upper end of the two parts. The tube 13 is fastened to a housing 16 of the temperature sensor 11 in a manner known per se, the housing 16 consisting of an insulating material, advantageously ceramic material. The rod 14 protrudes somewhat from the top of the tube 13 and rests against an intermediate pin 18 which is known per se and likewise consists of an insulating material, for example also ceramic or plastic.

The intermediate pin 18 has a pin arm 19 which protrudes laterally and acts on a first switching spring 20 of the temperature sensor 11, to be precise on the left-hand end region thereof. In its other, right-hand end region, the first switching spring 20 has a first switching contact 21, the first switching spring 20 essentially being constructed as known from the prior art, see the abovementioned EP 1 569 257 A1, for example. The left-hand end region, with which the pin arm 19 engages in order to trigger the first switching spring 20, is connected, advantageously welded, to a first switching spring base 23. The right-hand end of this first switching spring base 23 is fastened to a metal first holding part 25, this first holding part 25 being permanently and immovably fastened in the housing 16. The triggering of the first switching spring 20 by moving the intermediate pin 18 along the direction of movement B is clear to a person skilled in the art and does not need to be explained in any more detail here. The switching point of said spring can be adjusted, for example, by adjusting the position of the pin arm 19 or the entire intermediate element 18 relative to the rod 14 to be triggered, in which case this is known to a person skilled in the art and does not need to be explained in any more detail here.

The upper end of the intermediate pin 18 rests directly against a second switching spring 28, to be precise, close to the right-hand end region of said spring, approximately between the centre and the right-hand end region. For this purpose, the intermediate pin can run through the first switching spring 20. This second switching spring 28 with a second switching spring contact 29 provided at the left-hand end is also constructed as known from the prior art, in particular as far as its switching behaviour and also its triggering point or switching point are concerned.

The first switching spring 20 is usually used to interrupt a power supply for a radiant heater whose operating temperature is intended to be monitored by the temperature sensor 11. The second switching spring 28 usually switches a heating display which thus indicates a residual temperature, which is still too high for contact, on a glass-ceramic hob above the radiant heater.

The right-hand end region of the second switching spring 28 is connected, advantageously welded, to a second switching spring base 31. The left-hand end region 32 of the second switching spring base 31 is fastened, again advantageously welded, to a second holding part 35. The right-hand end region of the second switching spring base 31 is fundamentally freely movable and can be virtually moved about its left-hand end region 32 with a movement similar to rotation. This rotational movability of the right-hand end region, which carries the second switching spring 28, upwards or downwards makes it possible to set or adjust the triggering point or switching point of said spring relative to the intermediate pin 18.

FIG. 1 also illustrates how a holder 37 is fastened to the housing 16 for the first switching spring 20 under the switching contact 21. The holder 37 may be, for example, an upright sheet metal strip of a sheet metal fastened in the housing 16. The FIGURE illustrates a slide 39 which is placed on the holder in the manner of a slider and at least partially engages over said holder in a U-shaped manner. The slide 39 can be moved on the holder 37 in the direction of the switching contact 21 and the mating contact or away from these. The slide 39 also consists of metal or sheet metal. At its upper end, the slide 39 has a mating holder 40 in the form of a short protruding pin which forms the counter-stop described at the outset. In this case, the mating holder 40 is bent out of the sheet metal of the slide 39, for example as a section. When the switching spring 20 is closed, the mating holder 40 reaches to just before the free end of said spring below the switching contact 21, the distance being able to be approximately 1 mm, for example.

In the case of the second switching spring 28, a second mating holder 42 is provided in a similar manner above the second switching spring contact 29, which second mating holder is bent out of the end of the left-hand end region 32 in a pin-like manner. Therefore, the second mating holder 42 is not directly displaceable or otherwise freely movable, in particular with respect to the second mating contact. For this purpose, the distance between the second mating holder 42 and the free end of the second switching spring 28 with the switching spring contact 29 can be changed by being bent towards or away from the mating contact to different extents.

Adjusting and Locking Method

When the second switching spring base 31 can still be moved, such adjustment of the second switching spring fastened to it is carried out by moving or rotating the second switching spring base. The latter is then intended to be fixed in its position. For this purpose, it has a locking arm 33 close to the right-hand end region, which arm protrudes approximately at right angles from the second switching spring base 31. Said arm rests against the second holding part 35 and can be fixed, advantageously welded, to the latter at a point of contact, in particular by means of a laser. The entire second switching spring base 31 is then fixed in its position and orientation, to be precise in just such a manner that the triggering point or switching point for the second switching spring 28 is adjusted to a particular desired temperature.

In this adjusting method, the first switching spring 20 or its triggering point or switching point should advantageously first of all be adjusted overall since this is generally effected by adjusting the position of the intermediate piece 18 relative to the rod 14.

In an alternative embodiment of the invention, which can be easily discerned by a person skilled in the art, it is possible to avoid locking that end region of the second switching spring base 31 to which the second switching spring 28 itself is also fastened when adjusting the second switching spring 28 and to lock the other end region instead. However, a different approach is appropriate in terms of the adjustment accuracy. Furthermore, although it is advantageous if said locking arm 33 is provided as far as possible at the end of the second switching spring base 31, since the adjustment accuracy is then greatest, this is not absolutely necessary. Design-related and structural stipulations as well as a good ability to reach the fastening point should likewise be considered.

As described above, the mating holder 40 and the second mating holder 42 can each be changed in terms of their distance from the free end of the respective switching spring or the respective mating contact and also the switching spring contact. If this distance is greater, the respective switching spring opens further. This in turn affects the triggering point during the closing movement, which takes place again shortly after the switch has opened, as a result of the expansion elements.

In order to accurately set the counter-stop, in particular the mating holder 40, the temperature at which the first switching spring 20 is intended to close again after previously opening is set or produced at the expansion elements 13 and 14. For this purpose, the mating holder 40 is moved relatively far away from the mating contact of the switching contact 21 and is then slowly moved towards it again until the switching spring 20 switches again at the set temperature and closes the contact or the switching contact 21 rests against the mating contact. The slide 39 is then fixed on the holder 37, for example by means of clamping or crimping, adhesive or else by means of welding or soldering.

If desired, the second mating holder 42 can be adjusted in a similar manner. In this case, the adjustment is effected by bending out or bending the mating holder to a greater or lesser extent in the direction of the second switching spring contact 29 or away from the latter.

The invention claimed is:

1. A temperature sensor with a housing, said temperature sensor comprising:

a first expansion element connected to said housing and being in a form of a tube and containing a second expansion element in a form of a rod, said first and said second expansion elements having different coefficients of thermal expansion;

a first switching spring being pre-stressed and comprising a switching contact, said rod acting on one side of said switching spring; and a second switching spring provided in a direction of said rod or of an intermediate element as an extension of said rod, said second switching spring fastened to a second switching spring base, wherein said second switching spring base is configured to be movable along a longitudinal direction of said rod thereby adjusting a switching point of said second switching spring, wherein locking means fixes a position of said second switching spring base, wherein said second switching spring base is elongated and is connected to said second switching spring in an end region of said second switching spring, wherein said end region is remotely positioned from a switching contact of said second switching spring, said second switching spring base fixed in an unalterable manner to another end region to said temperature sensor housing, and wherein an adjustable locking arm is provided in said end region between said second switching spring and said second switching spring base, wherein said locking arm is fixed to said temperature sensor housing or to a part fixed in said temperature sensor housing in a particular position.

2. The temperature sensor according to claim 1, wherein said rod rests against said first switching spring by means of said intermediate element in order to trigger said spring.

3. The temperature sensor according to claim 2, wherein an adjustable metal pin is provided at an end of said tube for adjusting a triggering point of said first switching spring, wherein said metal pin is configured to be movable in a longitudinal direction of said tube, and wherein said rod rests against said pin.

4. The temperature sensor according to claim 1, wherein said locking arm comprises a section protruding from said second switching spring base and said section is approximately at right angle to a longitudinal extent of said second switching spring base.

5. The temperature sensor according to claim 4, wherein said locking arm comprises a protruding locking arm being welded to a metal part fastened in said temperature sensor housing.

6. The temperature sensor according to claim 1, wherein a first switching spring base is fixed in its position in order to fasten said first switching spring or is designed such that it is unadjustable with respect to said temperature sensor housing.

7. A temperature sensor with a housing, said temperature sensor comprising:

a first expansion element being connected to said housing comprising a tube containing a second expansion element comprising a rod, said first and second expansion elements having different coefficients of thermal expansion;

a first switching spring being pre-stressed and comprising a switching contact, said rod acting on one side of said switching spring;

a second switching spring provided in a direction of said rod or of an intermediate element as an extension of said rod, said second switching spring fastened to a second switching spring base;

a mating contact being assigned to said switching contact; and a counter-stop provided for stopping said switching contact when said switching spring is open, wherein said counter-stop is configured to be adjustable either in a direction towards the mating contact or away from said mating contact prior to being fixed in position, wherein said counter-stop is configured to be adjustable approximately along a direction of movement of said switching contact during opening or closing of said switching spring prior to being fixed in position, wherein said counter-stop is crimped so as to be fixed in position to the housing, and wherein said counter-stop comprises a slide on a holder, and said slide and said holder being fixed to one another after setting said counter-stop.

8. The temperature sensor according to claim 7, wherein said counter-stop is configured to be bent for purposes of adjustment thereby setting a distance from said mating contact.

9. A method for adjusting a temperature sensor with a housing, said method comprising:

connecting a first expansion element to said housing and being in a form of a tube and containing a second expansion element in a form of a rod, said first and said second expansion elements having different coefficients of thermal expansion;

pre-stressing a first switching spring comprising a switching contact, said rod acting on one side of said switching spring;

providing a second switching spring in a direction of said rod or of an intermediate element as an extension of said rod, said second switching spring fastened to a second switching spring base, wherein said second switching spring base is configured to be movable along a longitudinal direction of said rod thereby adjusting a switching point of said second switching spring, wherein locking means fixes a position of said second switching spring base;

setting a switching point of said second switching spring at a particular temperature at which said second switching spring triggers or is intended to switch; and fixing a position of said second switching spring base by a locking means after setting said switching point.

10. The method according to claim 9, wherein said switching spring base is fixed in its position by welding a locking arm to a metal part in said temperature sensor housing.

11. The method for adjusting a temperature sensor according to claim 9, wherein, at said particular temperature at which said switching spring is intended to close again thereby contacting a counter-stop, said counter-stop is moved in a direction of a mating contact until said switching spring switches again or closes at said temperature.

12. The method according to claim 11, wherein, at said particular temperature, said counter-stop is fixed in position.

13. The method according to claim 12, wherein said counter-stop is fixed permanently by means of welding.

* * * * *